US006883207B2

(12) United States Patent
Le Roux

(10) Patent No.: US 6,883,207 B2
(45) Date of Patent: Apr. 26, 2005

(54) APPARATUS FOR HOLDING BAGS

(76) Inventor: Paul André Le Roux, 1302 Esplanade, #120 North, Redondo Beach, CA (US) 90277

( * ) Notice: Subject to any disclaimer, the term of this patent is extended or adjusted under 35 U.S.C. 154(b) by 179 days.

(21) Appl. No.: 10/028,486

(22) Filed: Dec. 19, 2001

(65) Prior Publication Data

US 2003/0110593 A1 Jun. 19, 2003

(51) Int. Cl.[7] ..... A45C 13/22

(52) U.S. Cl. ..... 16/428; 16/406; 294/137; 294/158

(58) Field of Search ..... 16/428, 406, 444, 16/445; 294/26, 137, 158, 159

(56) References Cited

U.S. PATENT DOCUMENTS

| | | | | |
|---|---|---|---|---|
| D356,261 | S | * | 3/1995 | Miceli, Jr. |
| D361,263 | S | * | 8/1995 | Carmo et al. |
| 5,441,323 | A | * | 8/1995 | Goddard ..... 294/158 |
| 5,487,581 | A | * | 1/1996 | Carmo et al. ..... 294/137 |
| 5,511,445 | A | | 4/1996 | Hildebrandt |
| 5,645,306 | A | * | 7/1997 | Kosteniuk ..... 294/137 |
| 5,797,166 | A | | 8/1998 | Wagenheim |
| 5,992,803 | A | | 11/1999 | Le Roux |
| 6,006,403 | A | * | 12/1999 | Battiato ..... 16/421 |
| D423,348 | S | * | 4/2000 | Le Roux |
| D441,653 | S | * | 5/2001 | LeRoux |
| D455,348 | S | | 4/2002 | Fludd |
| D466,014 | S | | 11/2002 | Le Roux |
| D469,015 | S | * | 1/2003 | LeRoux |
| 6,585,204 | B1 | * | 7/2003 | Haertzen ..... 248/211 |

FOREIGN PATENT DOCUMENTS

| | | |
|---|---|---|
| EP | 0007888 A1 | 6/1980 |
| FR | 2632933 A | 12/1989 |
| FR | 2659626 A | 9/1991 |
| SU | 1652208 A | 5/1991 |

OTHER PUBLICATIONS

Entrepreneur Magazine, Aug. 2002, p. 102.
Parade Magazine, Nov. 17, 2002, p. 20.
"Grip–It," www.gripit.com.
"TotASaK," www.gaimway.com.

* cited by examiner

*Primary Examiner*—Suzanne Dino Barrett
*Assistant Examiner*—Mark Williams
(74) *Attorney, Agent, or Firm*—Knobbe, Martens, Olson & Bear, LLP.

(57) ABSTRACT

An apparatus including a handle member including a body portion having an opening there through, the handle member suitable for grasping with fingers of a human hand through the opening; a cantilever portion having a base end and a free end, the base end coupled to the handle member, the coupling defining a slot between the free end of the cantilever portion and the handle member, the slot being suitable for inserting the handle of a bag, and a hook attached to the cantilever portion and blocking a portion of the slot.

18 Claims, 4 Drawing Sheets

APPARATUS FOR HOLDING BAGS

BACKGROUND

Bags with handles are becoming a popular means for people to carry goods. Many markets, for example, generally offer plastic bags to customers for carrying groceries. These plastic bags include integral handles that allow customers to carry the bags by the handle. Often, however, these bags filled with goods are often cumbersome to carry even over short distances. U.S. Pat. No. 423,348 describes a bag holder to aid in hand-carrying one or more bags.

BRIEF DESCRIPTION OF THE DRAWINGS

The invention is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

DETAILED DESCRIPTION

Figure 1:
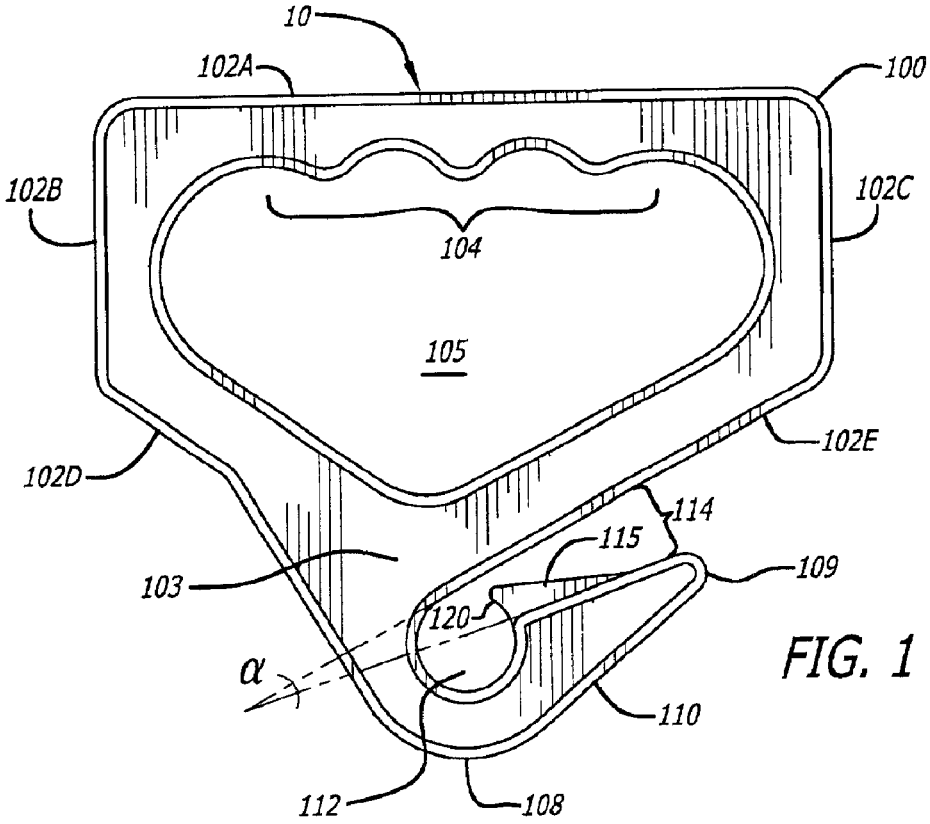
FIG. 1 is a front side view of one embodiment of the bag holder, the rear elevational view being a mirror image of the front view.
Figure 2:
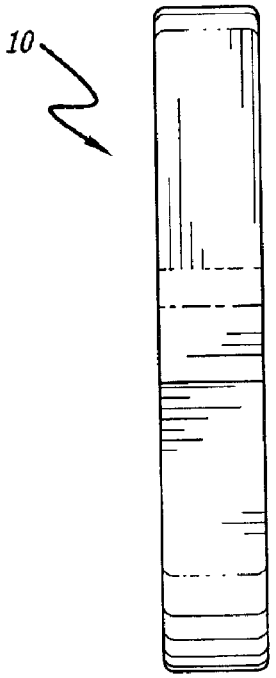
FIG. 2 is a left side elevational view of one embodiment of the bag holder.
Figure 3:
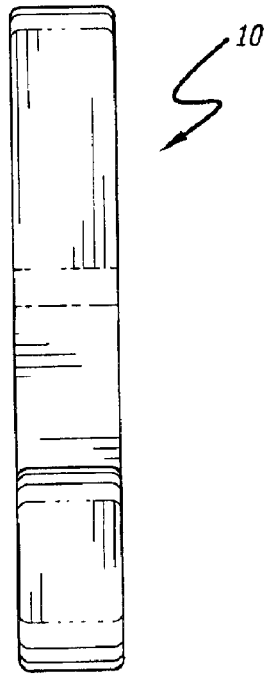
FIG. 3 is a right side elevational view of one embodiment of the bag holder.

FIGS. 1–3 illustrate an embodiment of an apparatus suitable as a bag holder. FIG. 1 is a front side view of one embodiment, the rear side view being a mirror image of the front view. FIG. 2 is a left side view and FIG. 3 is a right side view. In one embodiment, apparatus 10 comprises handle member 100 which has opening 105 making the handle member 100 suitable for grasping with the fingers of a human hand. In this embodiment, handle member 100 has a generally pentagonal-shaped body (as viewed in FIG. 3) with base 102A representing one side, two vertical side portions 102B and 102C, two diagonal portions 102D and 102E, and apex 103 (the base and apex inverted relative to FIGS. 1–3). Opening 105 generally follows the pentagonal shape of the body of handle member 105. Finger undulations 104 (spaced appropriately for fingers on an average human adult) are disposed on an inferior side (as viewed) of base 102A within opening 105. Apparatus 10 may be grasped (gripped) by the fingers of a human hand (e.g., within the clutch of four fingers) through opening 105 and about base 102A.

Apparatus 10 further includes cantilever portion 110 having a base end and a free end. Base end 108 is coupled to handle member 100 at about apex 103. Free end 109 of cantilever portion 110 extends at an angle, $\alpha$, of on the order of 0 to 20 degrees relative to an inferior portion (as viewed) of one diagonal portion (e.g., diagonal portion 102E in FIG. 3) of handle member 100, and at a distance from the interior portion of the diagonal portion. In this manner, slot 114 is formed between handle member 100 and cantilever portion 110. Still further, a base of slot 114, in one embodiment, defines circular well 112.

Apparatus 10 also includes hook 115 coupled to a superior surface (as viewed) of cantilever portion 110 so as to be disposed in slot 114. In the embodiment shown in FIG. 1, hook 115 is disposed between circular well 112 and free end 109 of cantilever portion 110.

In this embodiment, one edge 120 of hook 115 adapts an arc shape defining circular well 112. In one embodiment, the components of apparatus 10 described above (e.g., handle member 100, cantilever portion 110, and hook 115) are formed as one integral piece by, for example, a light plastic material formed in a mold to the shape illustrated.

In one embodiment, bag handles such as a pair of handles of one or more plastic groceries bags, may be positioned on apparatus 10 by maneuvering the pair of handles through slot 114, beyond hook 115 to well 112. Thus, a bag or multiple bags can be carried in a generally more comfortable manner by apparatus 10.

Often shoppers or consumers carry bags intermittently between the time they receive the bags of, for example, groceries at a supermarket, and the time they deliver the bags to their destination, for example, a residential kitchen. Shoppers may carry bags, for example, from the supermarket to their car, place the groceries in the trunk of their car, drive the car to their residence, and retrieve the bags from their car and take them into their residence. One concern with utilizing the convenience of a bag holder to transport the bags is that the bags are not retained by the bag holder when the bags are not being carried prior to their final destination.

Apparatus 10 minimizes the possibility of bags (e.g., bag handles of bags) thus inserted into or on apparatus 10 from sliding off of cantilever portion 110. In one embodiment, hook 115 minimizes the possibility by partially blocking slot 114. In the embodiment shown in FIG. 1, hook 115 has an edge 120 conforming to the shape of the well 112 to block a portion of slot 114. In another embodiment, hook 115 partially blocks slot 114.

Figure 4:
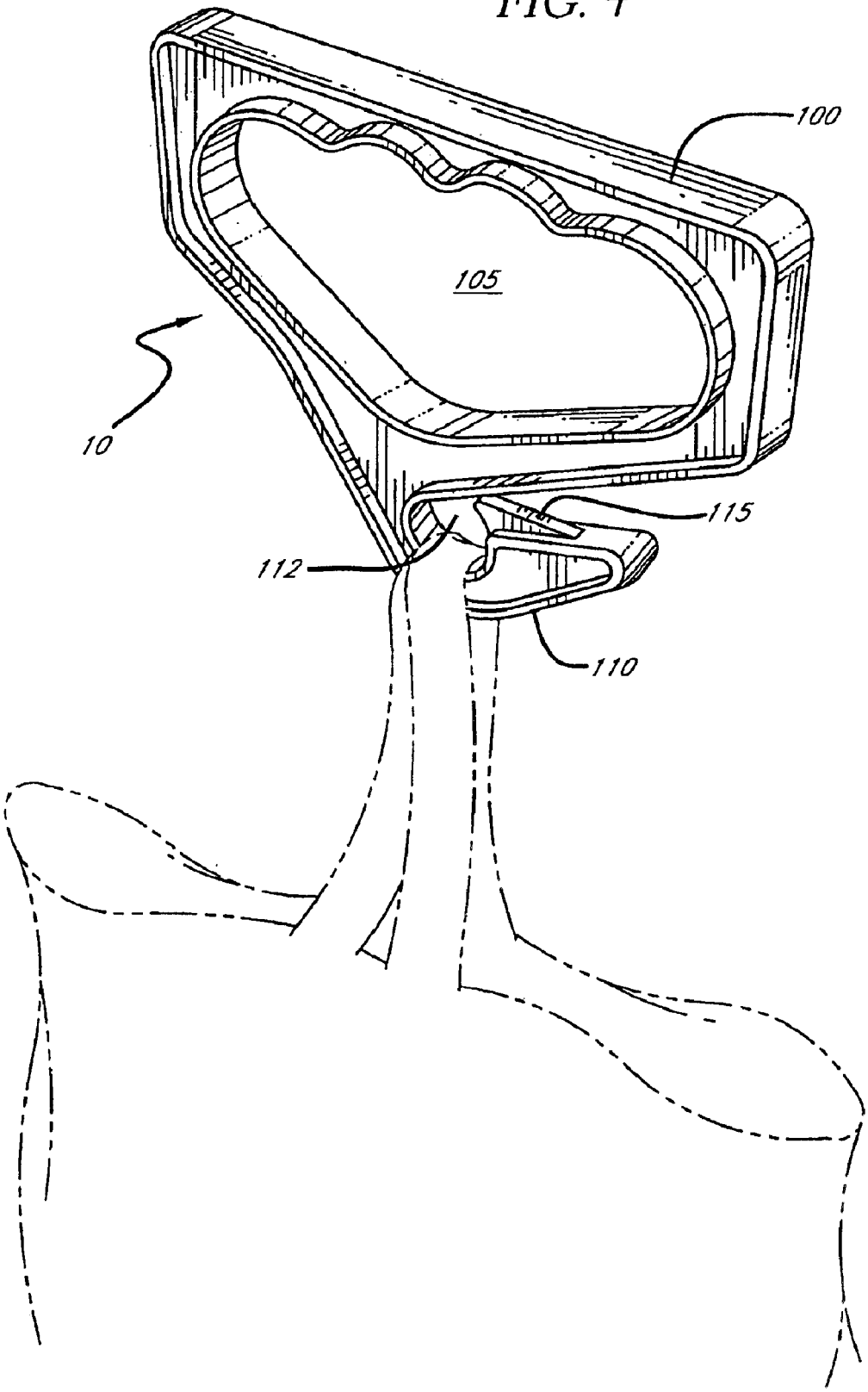
FIG. 4 is a diagrammatic perspective view of one embodiment of the bag holder in full lines with a bag shown in broken lines representing environmental association matter for illustrative purposes.
Figure 5:
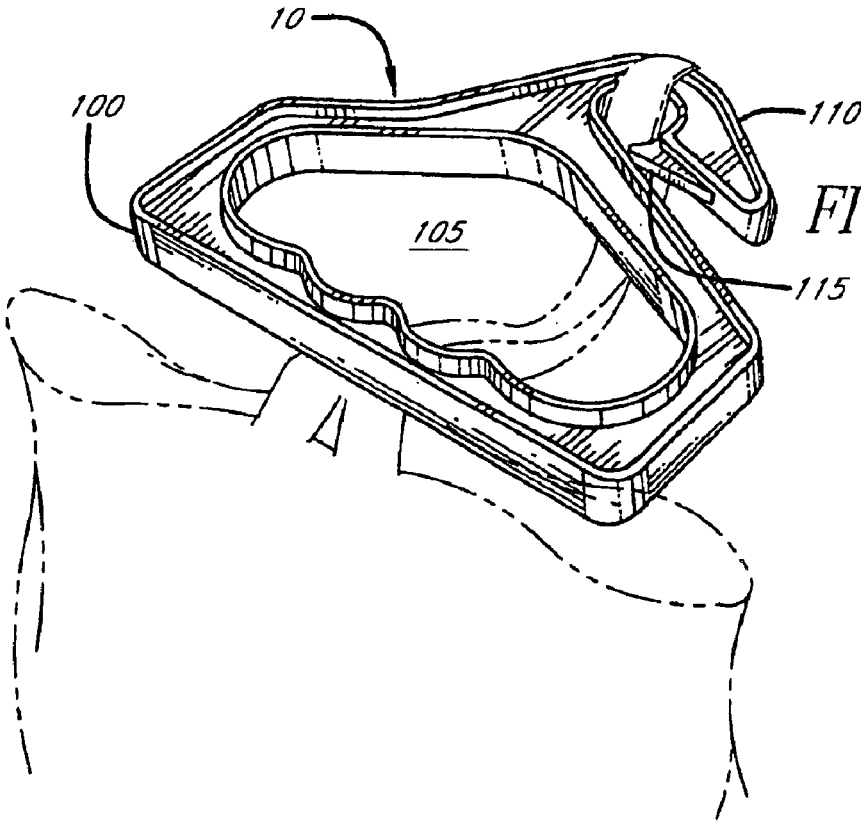
FIG. 5 is a diagrammatic perspective view of one embodiment of the bag holder positioned at an angle in full lines with a bag shown in broken lines representing environmental association matter for illustrative purposes.

FIGS. 4–5 present a diagrammatic perspective view of one embodiment of the bag holder in full lines with a bag shown in broken lines representing environmental association matter for illustrative purposes only and forming no part of the claimed invention. FIG. 4 illustrates the bag holder carrying a bag. The bag handles are fed through the slot formed between handle member 100 and cantilever portion 110. Hook 115 minimizes the opportunity for bag handles to slide out of well 120 and off of the cantilever portion 110. FIG. 5 illustrates that even when the bag holder is released from the grasp of a human hand and therefore not using the weight of the bags to stay in slot 115, hook 115 keeps bags from sliding off of the cantilever portion 110.

Figure 6:
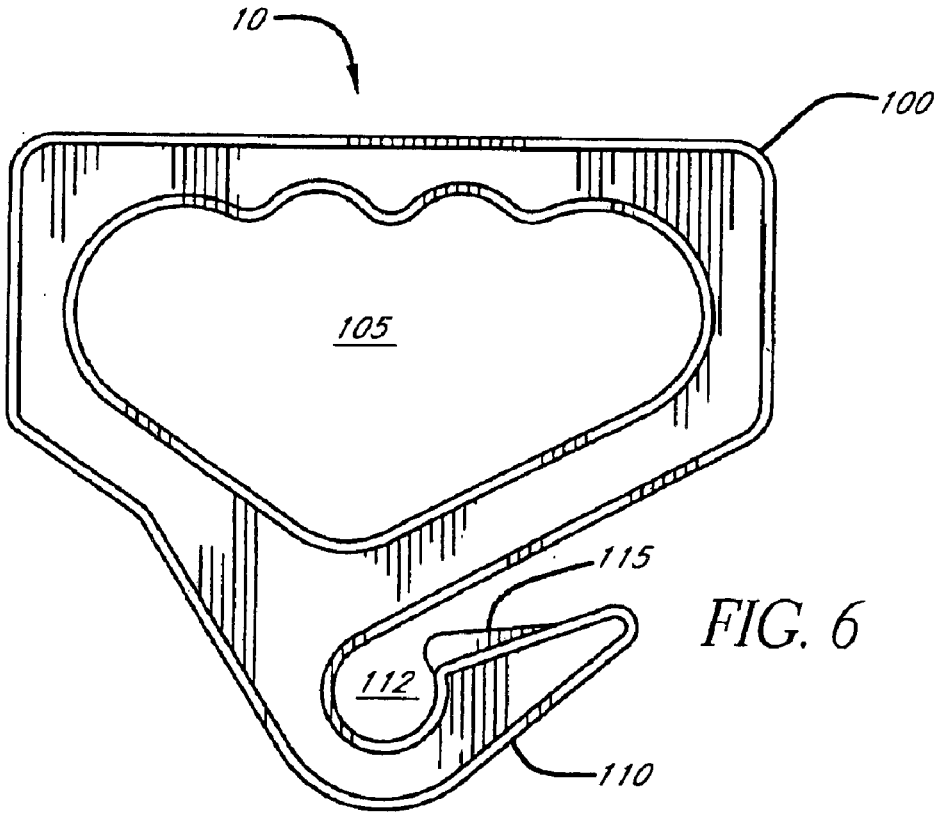
FIG. 6 is a front side view of another embodiment of the bag holder showing a round-edged hook, the rear elevational view being a mirror image of the front view.

FIG. 6 is a front side view of another embodiment of an apparatus including a round-edged hook 112 (rounded at its superior edge (as viewed) adjacent the well 112).

Figure 7:
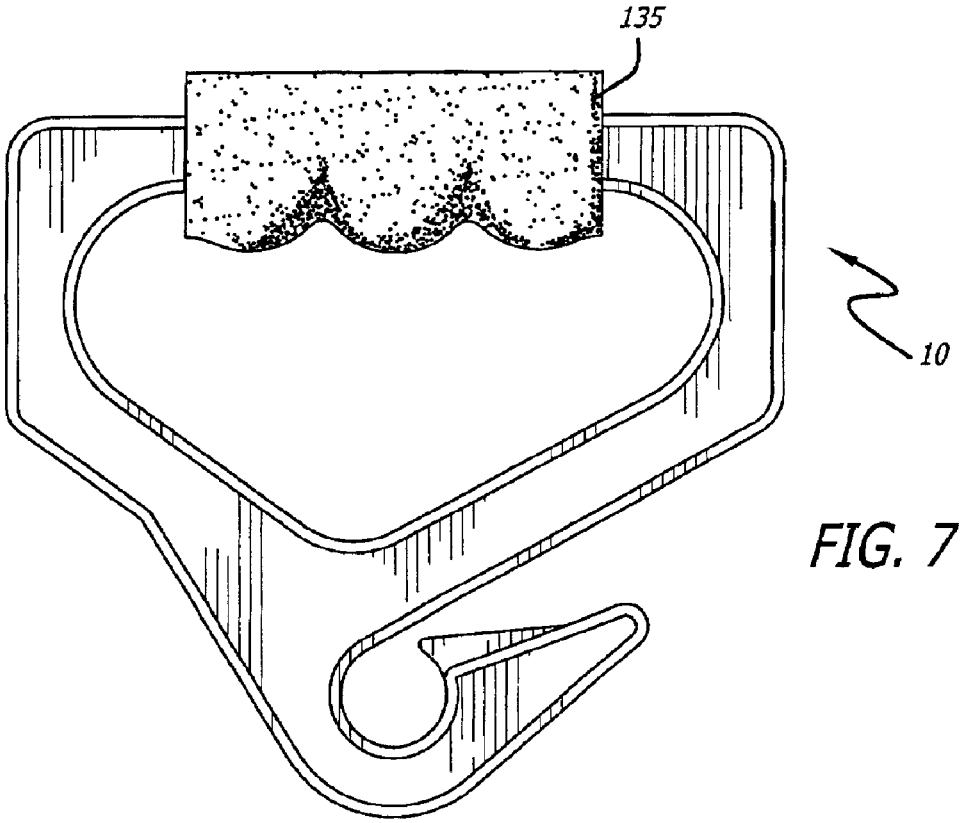
FIG. 7 is a front side view of still another embodiment of a bag holder having a supplemental handle portion on the handle member.
Figure 8:
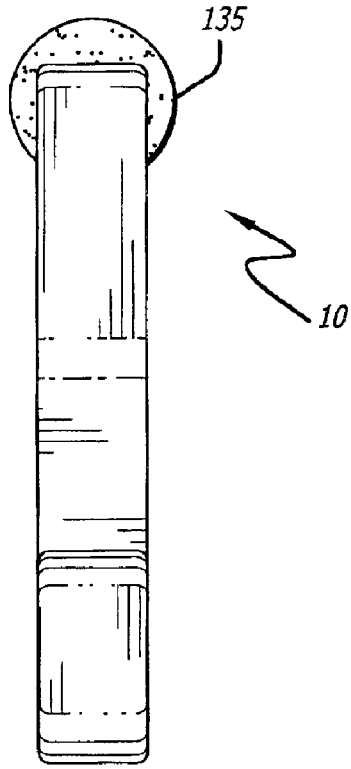
FIG. 8 shows a right side view of the embodiment of FIG. 7.

FIGS. 7 and 8 show another embodiment of apparatus 10. In this embodiment, apparatus 10 includes supplemental handle 135 coupled to the handle member. Supplemental handle 135 may be of a soft or giving material like a soft foamed or non-foamed polymer (e.g., synthetic rubber, neoprene, etc.) to provide a cushion to the hand of an individual carrying the apparatus. Supplemental handle 135 may be separately detachable to apparatus 10 with the other components formed as an integral unit.

In the preceding detailed description, the invention is described with reference to specific embodiments thereof. It will, however, be evident that various modifications and changes may be made thereto without departing from the broader spirit and scope of the invention as set forth in the claims. The specification and drawings are, accordingly, to be regarded in an illustrative rather than a restrictive sense.

What is claimed is:

1. An apparatus comprising:

a handle member comprising a body portion defining an opening therethrough, the opening configured to receive fingers of a human hand therethrough, the handle member configured to be grasped by said fingers;

a rigid cantilever portion having a base end and a free end, the base end coupled to the handle member defining a slot between the free end and the handle member, the slot being configured to receive at least one handle of at least one bag;

a hook extending into the slot between the free end and the handle member, the hook configured to block at least a portion of the slot, wherein at least a portion of the slot defines a generally circular well, the slot angled upwardly from the well toward the free end of the cantilever portion, and wherein the hook has a smaller thickness than the cantilever portion and has a generally triangular shape, the hook having an arcuate edge which is continuous with and forms a portion of the well, the arcuate edge terminating in a generally pointed distal end; and a small gap formed in the periphery of the well between the distal end of the hook and the slot, whereby bag handles are retained in the well by said hook but can easily be removed.

2. The apparatus of claim 1, wherein the hook has a sharp edge facing the well.

3. The apparatus of claim 1, wherein at least a portion of the slot defines a well, and wherein the hook has a rounded edge facing the well.

4. The apparatus of claim 1, wherein the handle member, the cantilever portion, and the hook comprise an integral body.

5. The apparatus of claim 1, wherein the hook has a first position blocking the slot and a second position providing access to the slot.

6. The apparatus of claim 1 further comprising a supplemental handle portion connected to the handle member, the supplemental handle member comprising a giving material.

7. The apparatus of claim 1, wherein the hook is attached to the cantilever portion.

8. The apparatus of claim 1, wherein the opening has a generally pentagonal shape.

9. The apparatus of claim 1, wherein the handle member and the cantilever portion are of a uniform thickness.

10. The apparatus of claim 1, wherein the hook has an edge generally conforming to the shape of a well defined by the slot.

11. A method for carrying bags comprising:

providing an apparatus comprising a handle member and a rigid cantilever portion, the handle member defining an opening therein and a slot between the handle member and the cantilever portion, the apparatus further comprising a hook attached to the cantilever portion, the hook having a smaller thickness than the cantilever portion, the slot defining a well and the hook in the slot being continuous with and forms a portion of the well and terminating in a generally barb-like point;

grasping the handle member through the opening;

inserting at least one handle of at least one bag over the cantilever portion and through a space defined by the hook extending into the slot such that the at least one handle is disposed in a well defined by the slot, wherein the hook is angled inwardly toward the well; and carrying the at least one bag having said at least one handle disposed in said well by holding the handle member.

12. The method of claim 11, wherein the hook substantially prevents the at least one handle disposed in the well from sliding off the at least one cantilever portion.

13. The apparatus of claim 1 further comprising:

a second cantilever portion having a base end and a free end, the base end coupled to the handle member defining a slot between the free end and the handle member, the slot being configured to receive at least one handle of at least one bag; and a hook extending into the slot between the free end of the second cantilever portion and the handle member, the hook configured to block at least a portion of the slot, wherein at least a portion of the slot defines a well, and wherein the hook is angled inwardly toward the well.

14. An apparatus comprising:

a handle member comprising a body portion defining an opening therethrough, the opening configured to receive fingers of a human hand therethrough, the handle member configured to be grasped by said fingers;

a cantilever portion having a base end and a free end, the base end coupled to the handle member defining a slot between the free end and the handle member, wherein at least a portion of the slot defines an arcuate well, the slot being configured to receive at least one handle of at least one bag;

a hook extending into the slot between the free end and the handle member, the hook having a smaller thickness than the cantilever portion, the hook configured to block at least a portion of the slot, the hook having an arcuate edge which is continuous with and forms a portion of the well, the arcuate edge terminating in a generally pointed distal end, wherein the well terminates in said generally pointed distal end; and a small gap formed in the periphery of the well between the distal end of the hook and the slot, whereby bag handles are retained in the well by said hook but can easily be removed.

15. An apparatus comprising:

a handle member comprising a body portion defining an opening therethrough, the opening configured to receive fingers of a human hand therethrough, the handle member configured to be grasped by said fingers;

a cantilever portion having a base end and a free end, the base end coupled to the handle member defining a slot between the free end and the handle member, wherein at least a portion of the slot defines a curved well, the slot being configured to receive at least one handle of at least one bag;

a hook extending into the slot between the free end and the handle member, the hook having a smaller thickness than the cantilever portion, the hook configured to block at least a portion of the slot, the hook having a curved edge continuous with and forms a portion of the well, the curved edge terminating in a barb-like distal tip; and a small gap having a fixed dimension formed in the periphery of the well between the hook and the slot, whereby bag handles are retained in the well by said hook but can easily be removed.

16. The apparatus of claim 15, wherein the distal tip is sharp.

17. The apparatus of claim 15, wherein the distal tip is defined by two edges of the hook, the edges being at an acute angle relative to each other.

18. The apparatus of claim 15, wherein the distal tip is not round.

* * * * *